United States Patent [19]

Hawk

[11] 4,212,272

[45] Jul. 15, 1980

[54] IDLE SPEED CONTROL DEVICE FOR INTERNAL COMBUSTION ENGINE

[75] Inventor: Rufus L. Hawk, Xenia, Ohio

[73] Assignee: General Motors Corporation, Detroit, Mich.

[21] Appl. No.: 959,327

[22] Filed: Nov. 9, 1978

[51] Int. Cl.[2] ..... F02D 11/10

[52] U.S. Cl. ..... 123/339; 123/198 DB; 123/350

[58] Field of Search ..... 123/97 R, 102, 198 DB, 123/DIG. 11

[56] References Cited

U.S. PATENT DOCUMENTS

| | | | |
|---|---|---|---|
| 2,355,090 | 8/1944 | Love et al. | 60/276 |
| 2,680,818 | 6/1954 | Ringwald | 123/102 |
| 2,799,373 | 7/1957 | Wagner | 192/3 G |
| 3,116,807 | 1/1964 | Wilson | 123/102 |
| 3,322,226 | 5/1967 | Marshall et al. | 123/102 |
| 3,338,225 | 8/1967 | Nicholson | 123/102 |
| 3,392,799 | 7/1968 | Ishikawa | 123/102 |
| 3,727,714 | 4/1973 | Ishikawa | 123/102 |
| 3,958,544 | 5/1976 | Shinoda et al. | 123/119 DB |
| 4,020,813 | 5/1977 | Hattori et al. | 123/124 R |
| 4,036,186 | 7/1977 | Hattori et al. | 123/124 R |

*Primary Examiner*—Charles J. Myhre
*Assistant Examiner*—Craig R. Feinberg
*Attorney, Agent, or Firm*—R. L. Phillips

[57] ABSTRACT

An idle speed control device of compact size has a miniature DC motor operably connected by a speed reducing gear train to drive a threaded shaft to adjust the position of a throttle stop for an engine throttle valve lever to thereby control engine idle speed wherein the throttle stop is initially moved by the throttle lever to close a normally open switch within the device to enable motor operation only during idle and wherein the threaded shaft disengages from the gear train when the throttle stop reaches a maximum throttle valve opening position while the motor continues to run and re-engages when the motor reverses.

3 Claims, 9 Drawing Figures

IDLE SPEED CONTROL DEVICE FOR INTERNAL COMBUSTION ENGINE

This invention relates to an idle speed control device for an internal combustion engine and more particularly to an idle speed control device which is operable to control the throttle plate or valve of an internal combustion engine during its idle mode.

With motor vehicle internal combustion engines, it is common practice to set the idle speed at a sufficiently high level to accommodate maximum anticipated generator load and also various accessory loads such as air conditioning and power steering which may be applied to the engine while idling. Typically, the idle setting is accomplished at the carburetor or fuel injection system, whichever the case may be, with a throttle stop screw which engages a lever on the throttle plate or valve to stop the lever at the desired minimum open position when the operator releases the accelerator pedal and the throttle is then forced toward closure by a throttle return spring. As a result, the engine idle speed is higher than it need be and more fuel is used than is necessary whenever the actual engine load is less than maximum anticipated during engine idle. Thus, substantial fuel savings could be realized if the throttle could be adjusted when the operator releases control thereof to maintain adequate rather than excessive throttle valve opening to meet the load and prevent stalling the engine.

The present invention is a compact low-cost unit which is mountable on the throttle valve body and is adapted to replace the conventional fixed throttle stop and be operated by appropriate electronics to automatically adjust the throttle to maintain constant idle speed for any engine load to improve fuel economy and also emission control and drivability and in addition may also serve as a replacement for the conventional fast idle cam commonly used for cold starting. The unit which will be referred to as an idle speed control device includes a miniature DC motor whose bi-directional rotary output is converted by a speed reducing gear train and a screw drive into precise advancement and retraction of a throttle stop which is engaged by the throttle valve lever under the force of the return spring when the operator releases the accelerator pedal. The device has a housing on which the motor is mounted and supports therein the speed reducing gear train which includes an annular throttle stop drive gear that is mounted in the housing concentric with a shaft. The shaft is connected to the throttle stop and is mounted for linear movement in the housing while being prevented from rotary movement. The shaft extends through the throttle stop drive gear and has axially spaced extension and retraction limit stops at opposite sides of the gear. The throttle stop drive gear has an internal nut thread and the shaft has a screw thread between its two limit stops which is engageable with the nut thread whereby when the motor is operated to turn the throttle stop drive gear in one direction, the shaft and connected throttle stop is caused to retract to effect throttle valve closing movement. A single-turn helical spring is arranged about the shaft between one side of the throttle stop drive gear and the retraction limit stop so as to yieldingly restrain the throttle stop in the maximum retraction position and urge extension thereof when the motor is reversed. When the motor is operated in reverse to cause the throttle stop drive gear to turn in the opposite direction, the shaft and connected throttle stop are caused to extend to effect throttle valve opening movement. The shaft also has an unthreaded free-wheel area between its two limit stops which is passable with clearance past the entire nut thread of the throttle stop drive gear as the shaft is extended and restrained by the extension limit stop engaging the other side of the throttle stop drive gear. The throttle stop drive gear is then threadingly disengaged and is free to rotate about the shaft when the motor remains on and the shaft is thus not locked-up with continuing motor torque. The throttle stop drive gear is caused to threadingly re-engage with the screw on the shaft by the force on the shaft applied by the throttle lever when the motor reverses direction. Thus, the throttle stop is prevented from being restrained in either its maximum retraction or extension position.

A switch for controlling whether the motor can operate is incorporated in the actuator and comprises a spring biased pivot plate which urges limited conjoint movement of the throttle stop drive gear, shaft and connected throttle stop in the extension direction and yields to the force of the throttle lever on the throttle stop to permit their conjoint movement in the retraction direction. The motor switch is normally held open by the pivot plate when the operator is depressing the accelerator pedal but on release thereof, the limited movement of the throttle stop drive gear, shaft and throttle stop in the retraction direction forced by the throttle lever engaging the latter causes the pivot plate to pivot and close the motor switch to then enable motor operation and thus throttle stop adjustment. The motor switch is eventually opened by the spring biased pivot plate when the throttle valve lever is removed from engagement with the throttle stop to then prevent motor operation and thereby throttle stop adjustment while the operator is controlling the engine throttle with the accelerator pedal.

An object of the present invention is to provide a new and improved idle speed control device for controlling the throttle of an internal combustion engine during idle.

Another object is to provide a new and improved, compact and reliable, low-cost idle speed control device providing an automatically adjustable throttle stop for controlling the throttle of an internal combustion engine during idle.

Another object is to provide an engine idle speed control device having a motor powered gear train and screw drive for adjusting a throttle stop to thereby control engine idle speed wherein the screw drive disengages at one limit of throttle stop travel while the motor continues to turn in one direction and is urged to re-engage when the motor reverses direction.

Another object is to provide an engine idle speed control device having a motor which is operable to drive a screw to adjust the position of a throttle stop for stopping a throttle lever to thereby control engine idle speed wherein the throttle stop is initially moved by the throttle lever to operate a switch within the device to enable motor operation only during idle.

Another object is to provide an idle speed control device for an internal combustion engine having a miniature DC motor operably connected by a speed reducing gear train and a screw drive to adjust the position of a throttle stop for the engine's throttle valve lever to thereby control engine idle speed wherein the screw will disengage from the gear train when the throttle stop reaches a certain limit to permit the motor to continue to run without forcing further movement of the throttle stop and wherein the throttle stop is initially moved by the throttle lever to close a normally open switch within the device to enable motor operation only during idle.

These and other objects of the present invention will be more apparent from the following description and drawings in which.

Figure 1:
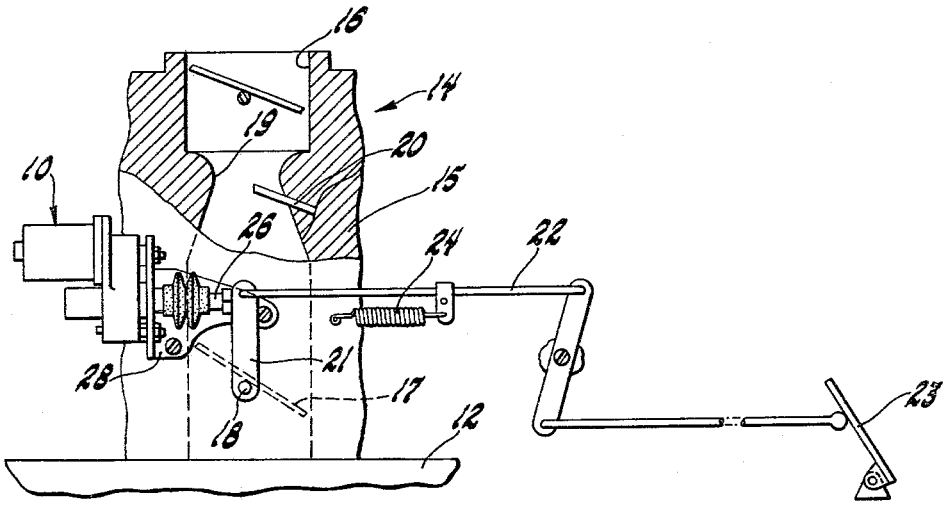
FIG. 1 is an elevational view of the preferred form of the idle speed control device according to the present invention mounted on the carburetor of a motor vehicle internal combustion engine.

Referring to FIG. 1, there is shown the preferred form of the idle speed control device of the present invention which is identified by the reference number 10 and is operable to control the idle speed of an internal combustion engine 12 of a motor vehicle, not shown. The engine 12 of which only a top portion is shown has a carburetor 14 having a throttle body 15 with a throttle bore 16 in which a throttle valve 17 is pivotly mounted by a shaft 18. The throttle valve 17 is located downstream of a venturi 19 into which fuel is delivered by a nozzle 20 in conventional manner. The throttle valve shaft 18 has a lever 21 fixed thereto which is operably connected by linkage 22 to an accelerator pedal 23 located in the vehicle's passenger compartment. The throttle valve is normally opened by the vehicle operator depressing the accelerator pedal and when the operator releases foot control thereof, the throttle lever 21 is returned and held by a return spring 24 against a throttle stop 26 on the idle speed control device 10 which is mounted by a bracket 28 on the throttle body 15. The idle speed control device 10 is operable to adjust the position of the throttle stop 26 thereby controlling the minimum open position of the throttle valve and thus the engine's idle speed when the operator releases the accelerator pedal.

Figure 2:
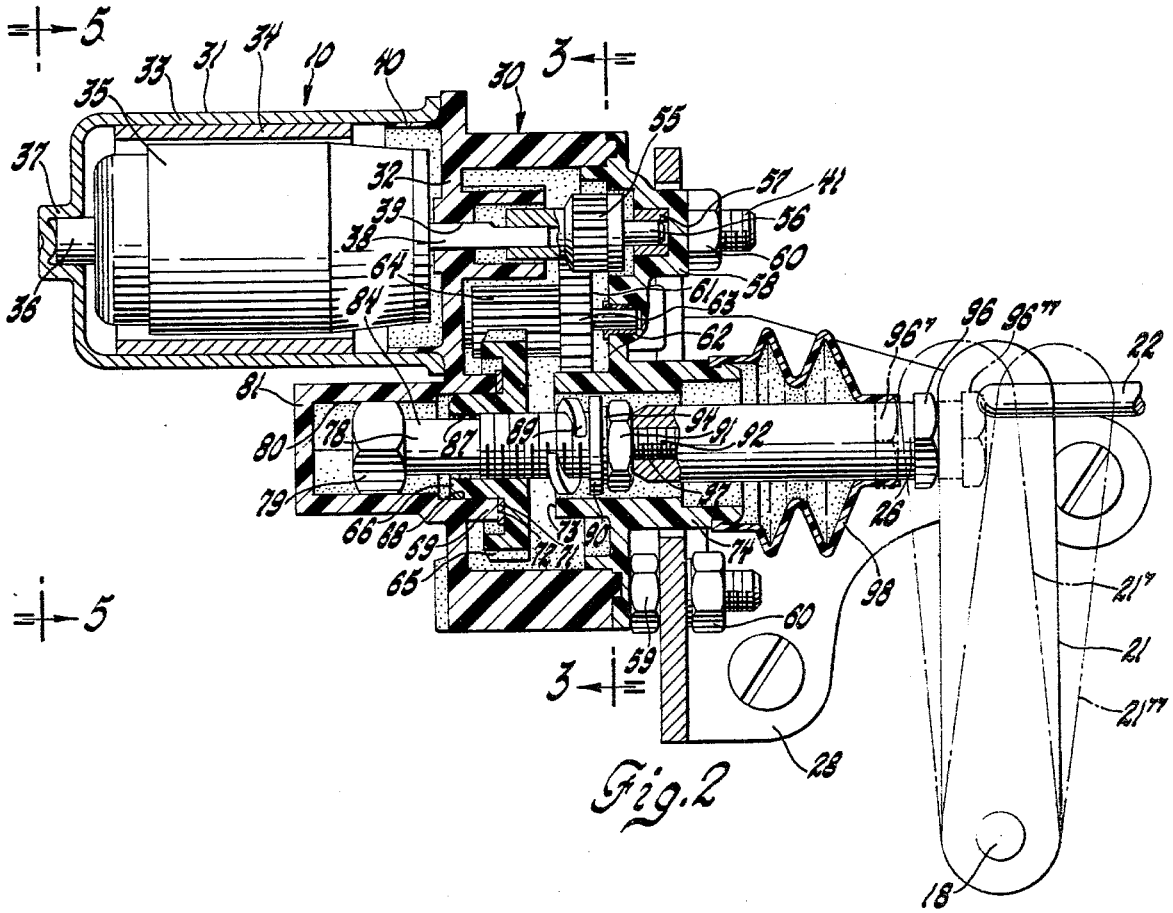
FIG. 2 is an enlarged longitudinal sectional view of the idle speed control device in FIG. 1 with the throttle stop shown in a mid-position.
Figure 3:
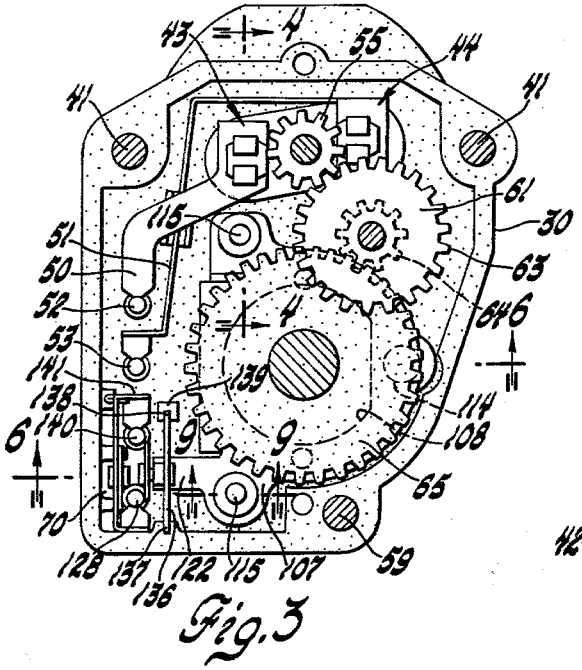
FIG. 3 is a view taken along the line 3—3 in FIG. 2.
Figure 5:
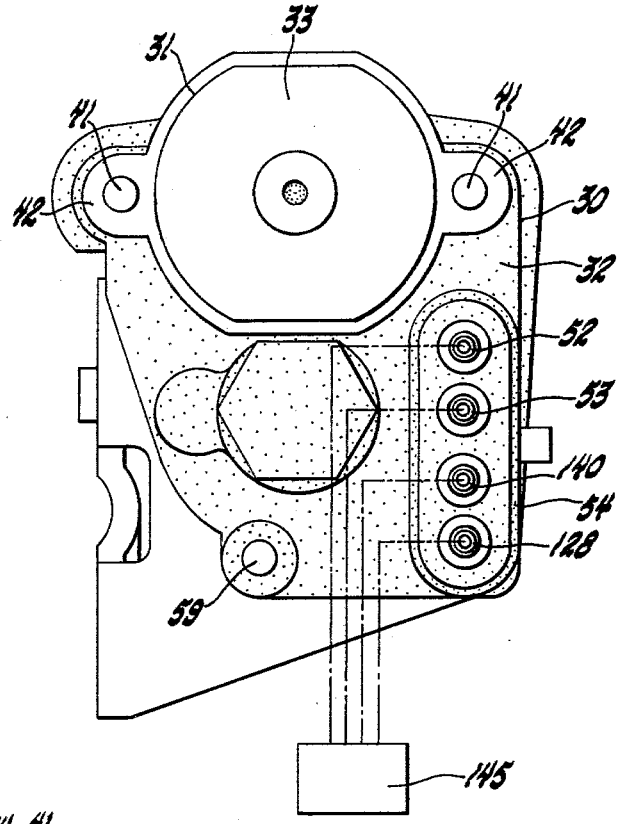
FIG. 5 is a view taken along the line 5—5 in FIG. 2.

As shown in FIGS. 2, 3, and 5, the device comprises a housing 30 which is preferrably an injection molded plastic part. The device is powered by a miniature DC motor 31 which is mounted on a closed end 32 of the housing and comprises a metal case 33 in which a permanent magnet 34 is secured. An armature 35 is centered in the magnet and has a hub 36 at one end which is rotatably supported in a sleeve bearing 37 formed in the closed end of the case. The armature 35 has a shaft 38 extending from the other end which is rotatably supported in and extends through a hole 39 in the housing end wall 32. The motor case 33 is pivoted at its open end into proper alignment on the housing by a collar 40 projecting from the outside of the housing end wall 32. The motor case is secured in place by a pair of bolts 41 which extend through holes in the housing and engage threaded holes in ears 42 that depend from the open end of the motor case and are located diametrically opposite each other as shown in FIG. 5.

Figure 4:
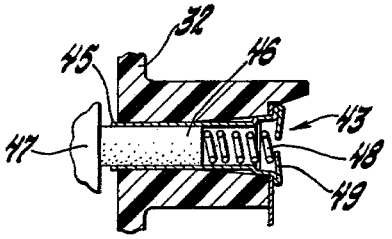
FIG. 4 is a view taken along the line 4—4 in FIG. 3.

Referring to FIG. 3, power to the motor is provided by two terminal and eyelet assemblies 43 and 44. As shown in FIG. 4, each of these assemblies includes an eyelet 45 which is pressed in a hole in the housing end wall 32 and which has mounted therein a brush 46 that is biased to engage the motor's commutator 47 by a coil spring 48. The spring 48 is retained by bent tabs 49 on the eyelet as shown in FIGS. 3 and 4 and these tabs also serve to secure the respective eyelets to one end of two terminal strips 50 and 51. The respective terminal strips 50 and 51 are secured at their opposite ends to terminals 52 and 53 which are pressed in holes in the housing end wall 32. The terminals 52 and 53 comprise part of an oblong connector 54 which is formed on the exterior of the housing end wall 32 as shown in FIG. 5.

Drive from the motor 31 to adjust the throttle stop 26 is provided by a pinion 55 which is keyed to the motor shaft 38 and has a spindle 56 which is supported by a plain bearing 57 in a housing cover 58. Cover 58 is preferably an injection molded plastic part and is secured to the open end of the housing 30 by the two bolts 41 and an additional bolt 59. These bolts also serve to secure the mounting bracket 28 to the device with the aid of nuts 60 as shown in FIGS. 2, 3, 5, and 6.

The pinion 55 drives an idler 61 which as shown in FIG. 2 is rotatably supported at one end in the housing end wall 32 and is rotatably supported at its other end in a plain bearing 62 which is mounted in the cover 58. The idler 61 has a large diameter gear 63 which meshes with the pinion 55 and a small diameter, elongated gear 64 which meshes with an annular throttle stop drive gear 65. The throttle stop drive gear 65 has a hub by which it is rotatably supported in a bore 68 in the housing end wall 32 and an inwardly projecting portion 69 thereof. The drive gear 65 is also permitted to move axially but only to a limited extent and while retaining meshing engagement with the small idler gear 64 which is elongated for that purpose.

Figure 6:
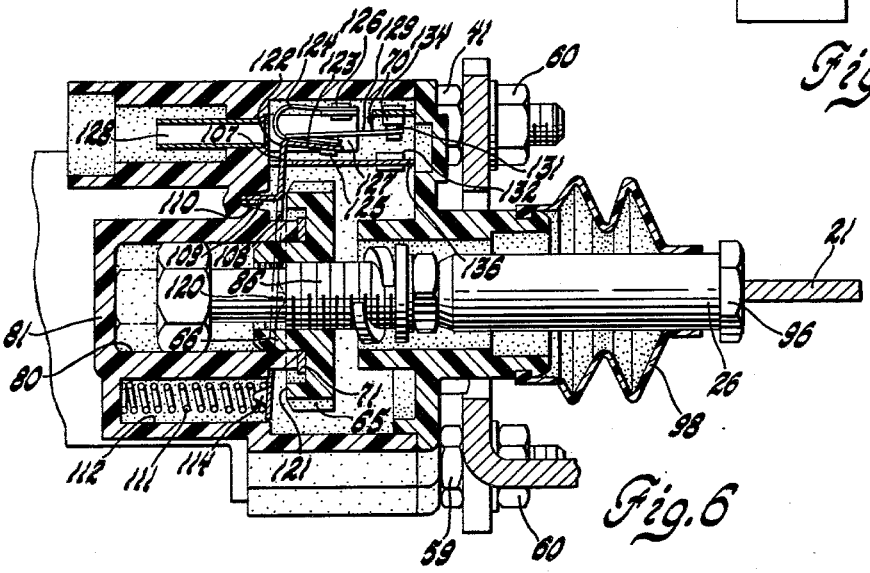
FIG. 6 is a view taken substantially along the line 6—6 in FIG. 3 with the motor switch closed.
Figure 7:
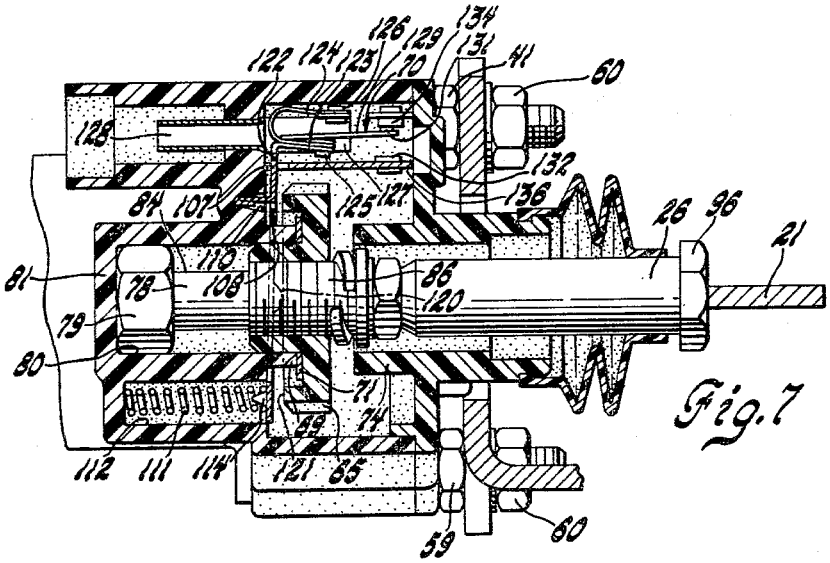
FIG. 7 is a view similar to FIG. 6 but with the throttle stop fully retracted.

Limited movement of the throttle stop drive gear 65 is for operation of a motor switch 70 shown in FIG. 3 to enable motor operation and thus idle speed control as will be described in more detail later. The drive gear's travel is limited in one direction by one side thereof engaging a thrust washer 71 against the annular end 72 of the projection 69 on the housing end wall 32 as shown in FIGS. 2, 6, and 7. Movement in the other direction after a predetermined amount of travel is prevented by the other side of the drive gear engaging the annular end 73 of a cylindrical sleeve 74 on the cover 58 as shown in FIG. 8.

Figure 8:
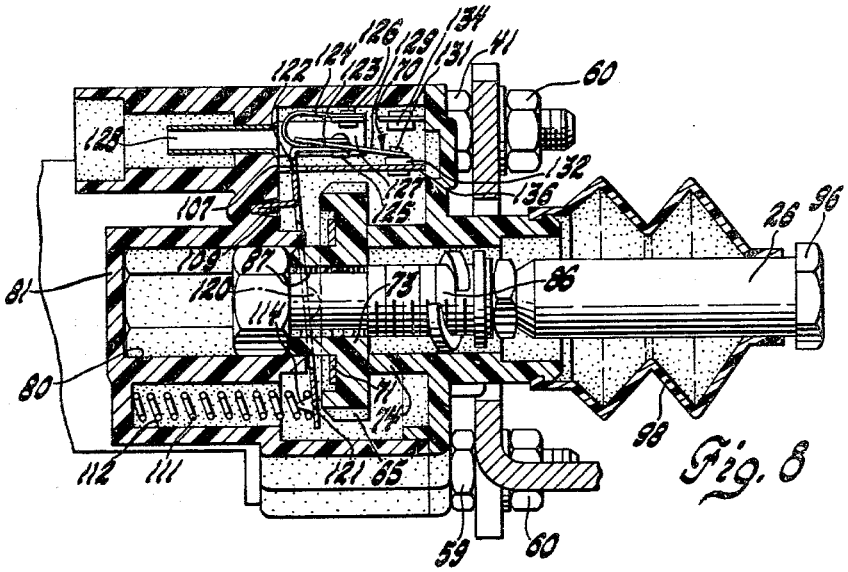
FIG. 8 is a view similar to FIG. 6 but with the throttle stop fully extended and the motor switch open.

The throttle stop 26 is part of an assembly which is translated by the drive gear 65 between a maximum retraction position as shown in FIG. 7 establishing minimum throttle valve opening and a maximum extension position as shown in FIG. 8 establishing maximum throttle valve opening with the accelerator pedal released. The throttle stop assembly further includes a shaft 78 having a hexagonal shaped head 79 which is slidably received in a correspondingly shaped but elongated socket 80 that is aligned with the drive gear 65 and is formed by a projection 81 integral with and projecting outwardly from the housing end wall 32. The shaft 78 is thereby permitted to translate axially of the throttle stop drive gear 65 but is prevented from rotation. The shaft 78 adjacent its hexagonal head 79 has a cylindrical portion 84 that is equal or slightly greater in length than the length of the throttle stop drive gear's hub 66 for reasons that will become more apparent later. The shaft 78 has immediately adjacent its cylindrical portion 84 an enlarged diameter portion having a right hand screw thread 86 which engages with an internal nut thread 87 formed in the hub 66 of the throttle stop drive gear 65. The threaded shaft portion 86 extends past the gear 65 into the sleeve 74 on the cover 58 and a single-turn coil spring 89 of rectangular cross-section is received thereabout. A washer 90 is held against a shoulder on the shaft 78 at the right hand end of the threaded portion 86 and is retained in place by a nut 91 which is threaded to a reduced diameter threaded portion 92 formed on the right hand end of the shaft 78, there being provide a lock washer 94 between the nut and washer 90 to prevent the nut from backing off. The spring 89 differs from a lock washer in that is is twisted opposite that of the threads 86 and 87 so as to promote, rather than prevent, the limit stop provided by the washer 90 from backing off from the throttle stop drive gear 65. The throttle stop 26 has a hexagonal head 96 at one end for engagement by a wrench and at the other end is provided with a locking thread insert 97 by which the throttle stop is lockingly threaded at any desired position along the end thread 92 of the shaft 78. The throttle stop 26 projects outwardly from the sleeve 74 of the cover 58 to be engaged by the throttle lever 21 as shown in FIGS. 1, 2, 6, and 7 and there is provided a bellows-type boot 98 between the throttle stop and the sleeve to prevent undesirable matter from entering the interior of the device.

Figure 9:
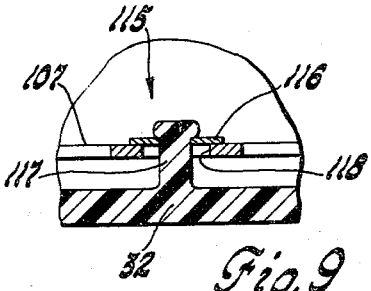
FIG. 9 is a view taken along the line 9—9 in FIG. 3.

The switch 70 is provided to make the idle speed control device operational to control the engine throttle only in the idle mode which occurs when the vehicle operator releases the accelerator pedal 23. Referring to FIGS. 3, 6, 7, and 8, the switch includes a pivot plate 107 having a central opening 108 by which it is received about the inward projection 69 of the housing end wall 32 and the hub 66 of the throttle stop drive gear 65. The pivot plate 107 has a depending fulcrum arm 109 formed integral therewith which extends chordally of the opening 108 and is received in a depression 110 formed in the interior side of the housing end wall 32. The pivot plate 107 is pivotal about the end of the fulcrum arm 109 and at its lower end as viewed in FIG. 6 is biased by a coil spring 111. The coil spring 111 is seated at one end on the bottom of a cavity 112 formed in the end wall projection 81 parallel to the shaft cavity 80. The other end of the spring 111 is seated on the pivot plate 107 at a location determined by a cone-shaped projection 114 formed thereon. The pivot plate 107 is retained on the end wall 32 and the spring 111 is preloaded by a pair of staked assemblies 115 which are located adjacent the opposite ends of the fulcrum arm 109. As shown in FIG. 9, each of staked assemblies 115 comprises a washer 116 which is secured to the interior of the housing end wall 32 by a stake 117 which is formed integral therewith and extends through an openings 118 in the pivot plate 107 intermediate its fulcrum and the coil spring 111. The pivot plate 107 has a pair of bumps 120 which are contacted by a flat annular face 121 on the throttle stop drive gear 65 at diametrically opposite locations and upon release of the throttle return spring load on the throttle stop 26 and regardless of where the drive gear 65 is located with respect to the shaft 78, the spring 111 is then operable to pivot the pivot plate 107 counterclockwise about its fulcrum arm 109 from the switch closed position shown in FIGS. 6 and 7 to the switch open position shown in FIG. 8 and thereafter hold the latter position as long as the throttle lever 21 is off the throttle stop 26. Alternatively, when the throttle return spring load forces the throttle lever 21 to be held against the throttle stop 26 upon release of the accelerator pedal, the throttle stop 26 and shaft 78 are moved leftwardly and the drive gear 65 is moved along therewith regardless of its position on the shaft to force the pivot plate to then pivot clockwise against the bias of spring 111 from the switch open position shown in FIG. 8 to the switch closed position shown in FIGS. 6 and 7.

The pivot plate 107 operates the switch 70 through an arm 122 which depends therefrom adjacent the lower staked assembly 115 as viewed in FIG. 3 and to the left of the fulcrum arm 109. The arm 122 extends adjacent the interior of the housing end wall 32 and terminates with an inward right angle bend 123. A conductor 124 is connected at one end by a rivet 125 to the bent end 123 of the pivot plate arm 122 and is connected at its other end by a rivet 126 to a projection 127 on a terminal 128 which is pressed in a hole in the housing end wall 32 and forms a third terminal of the connector 54. A switch blade 129 is also secured by the rivet 125 to the bent end 123 of the pivot plate arm and has a contact 131 which is located between a fixed stop 132 and a contact 134. The stop 132 is mounted on a shield 136 which is supported along opposite side edges in slots 137 and 138 which are formed respectively in the interior of the side wall of housing 30 and in a post 139 which is formed integral with and projects from the housing end wall 32 as shown in FIG. 3. The shield 136 has an opening at its inner end through which the pivot plate arm 122 extends to the switch and the shield acts to help shield the switch contacts from the other operating parts in the device. The contact 134 is fixed to a terminal 140 which is pressed in a hole in the housing end wall 32 and forms the fourth and last terminal of the connector 54. The terminal 140 also includes a flange 141 which completes the shielding of the switch contacts. The above switch components are thus arranged so that when the pivot plate 107 is pivoted by throttle lever engagement with the throttle stop 26, the switch blade 129 snaps and holds the switch contact 131 against the terminal contact 134 to connect terminals 128 and 140. Alternatively, when the pivot plate 107 is pivoted by the spring 111 on removal of the throttle return spring force when the operator depresses the accelerator pedal, the switch blade 129 snaps the contact 131 against the stop 132 to disconnect the motor switch terminals 128 and 140.

The idle speed control device 10 is adapted to operate in a motor vehicle with an electronic control unit 145 shown in FIG. 5 which is operational whenever the switch 70 is closed connecting the terminals 128 and 140 to then apply a DC voltage across the motor terminals 52 and 53 of reversible polarity to cause the motor 31 to turn in either direction and for a certain period of time to establish and maintain a desired engine idle speed under various conditions. Describing now the typical operation of the device in such an arrangement, when the vehicle operator releases the accelerator pedal 23, the throttle return spring 24 forces and holds the throttle lever 21 against the throttle stop 26. The initial contact of the throttle lever with the throttle stop forces conjoint limited movement of the throttle stop and connected shaft 78 until the throttle stop drive gear 65 which is moved therewith is stopped by the thrust washer 71 as shown in FIG. 2 after having moved from its other extreme position shown in FIG. 8. This limited movement of the throttle stop drive gear 65 pivots the pivot plate 107 clockwise to close the switch 70 and thus enable motor operation so long as the accelerator pedal remains released. Voltage may then be applied to the motor 31 according to a prescribed program and when the polarity is such that the motor causes the throttle stop drive gear 65 to turn in the counterclockwise direction as viewed in FIG. 3 and with the drive gear 65 and shaft 78 in threaded engagement as shown in FIG. 2 and the shaft prevented from rotation, the shaft and connected throttle stop 26 are caused to move leftwardly or retract and stop on cessation of motor operation. This permits the spring biased throttle lever 21 to pivot counterclockwise as viewed in FIG. 2 to a new position thereby decreasing the throttle valve opening. Continued motor operation in this mode eventually causes the spring 89 to contact the right hand side of the throttle stop drive gear 65 and be slightly compressed thereagainst by the retraction limit stop provided by the washer 90 as shown in FIG. 7. This retraction limit stop engagement determines maximum retraction of the throttle stop and thus minimum throttle valve opening and is depicted by the phantom line positions of the throttle stop and throttle lever designated as 21' and 96' in FIG. 2. When a wider idle throttle valve opening is demanded, voltage of reverse polarity is applied to the motor causing the drive gear 65 to turn clockwise as viewed in FIG. 3. The spring 89 then expands to assist the washer 90 on the shaft 78 in moving away from the rotating drive gear 65 while the return spring 24 maintains the drive gear leftward against the thrust washer 71 as the drive gear turns. The shaft 78 with throttle stop 26 is thus caused to move rightward in an extension direction pivoting the throttle lever 21 clockwise as viewed in FIG. 2 to a new position thereby increasing the throttle valve opening with cessation of motor operation according to program stopping the throttle stop at the demanded position. Continued extension of the throttle stop 26 can occur until the extension limit stop provided by the shaft head 79 engages the left hand side of the drive gear 65 as shown in FIG. 8 at which point the shaft thread 86 disengages from the drive gear thread 87 so that the motor can continue to turn without stalling because the drive gear then freewheels about the unthreaded portion 84 of the shaft. This extension limit stop engagement determines maximum extension of the throttle stop and thus maximum throttle valve opening and is depicted by the phantom line positions of the throttle stop and throttle lever designated as 21" and 96" in FIG. 2. Then when the motor is reversed to turn the drive gear counterclockwise as viewed in FIG. 3, the force on the shaft 78 applied by the throttle return spring 24 forces threaded re-engagement of the shaft with the drive gear whereupon such engagement is effective to cause retraction of the throttle stop as before described for decreased throttle valve opening.

Finally, when the operator depresses the accelerator pedal 23 to take over throttle valve control, the throttle valve lever 21 moves away from the throttle stop 26 as shown in FIG. 8. With the force of the return spring 24 thus removed from the shaft 78, the drive gear 65 and shaft 78 are then permitted to be moved rightward by the spring 111 pivoting the pivot plate 107 counterclockwise until the right hand side of the drive gear engages the housing stop 73. This movement of the pivot plate opens the switch 70 so that motor operation may not continue and the throttle stop is thus retained in its last commanded position.

It will be understood, of course, by those skilled in the art that while the idle speed control device according to the present invention has been described in use to control a throttle valve lever, the device is also adaptable for use in other engine fuel control systems wherein the throttle linkage is adjustable to control engine idle speed. And it will be further understood that the above described preferred embodiment is illustrative of the invention which may be modified within the scope of the appended claims.

The embodiments of the invention in which an exclusive property or privilege is claimed are defined as follows:

1. An idle speed control device for an internal combustion engine having a throttle valve control member that is spring biased in a valve closing direction, said device comprising housing means adapted to be mounted on the engine, a shaft supported by said housing means having a throttle stop at one end adapted to be engaged by and stop the throttle valve control member in various throttle valve idle positions as determined by the axial position of said shaft, said shaft and said housing means having cooperating shaft mounting means by which said shaft is free to move axially but cannot rotate, a reversible motor mounted on said housing means, speed reducing gear means mounted in said housing means including an annular gear that is driven at reduced speed by said motor and is free to move axially to a limited extent, said housing means including gear travel stop means for limiting axial movement of said annular gear, said shaft extending through and having extension and retraction stop means facing opposite sides of said annular gear, said annular gear having an internal thread, said shaft having a screw thread between its two said stop means engageable with the thread in said annular gear whereby said shaft is caused to retract to effect throttle valve closing movement on rotation of said annular gear in one direction by said motor and said shaft is caused to extend to effect throttle valve opening movement on rotation of said annular gear in the opposite direction by said motor, a pivot plate pivotally supported in said housing means, spring means for pivoting said pivot plate to engage and hold said annular gear against one of said gear travel stop means when the throttle control member is removed from said throttle stop and yielding to permit said annular gear to move to engage and be held against the other of said gear travel stop means when the spring biased throttle control member engages said throttle stop, and switch means mounted in said housing means for controlling whether said motor can operate, said switch means including a switch blade connected to said pivot plate so as to close said switch means to permit motor operation when the pivot plate is forced to pivot and hold said annular gear against said other gear travel stop means by the spring biased throttle control member engaging said throttle stop and to open said switch means to prevent motor operation when the pivot plate is forced to pivot and hold said annular gear against said one gear travel stop means when the throttle control member is removed from said throttle stop.

2. An idle speed control device for an internal combustion engine having a throttle valve control member that is spring biased in a valve closing direction, said device comprising housing means adapted to be mounted on the engine, a shaft supported by said housing means having a throttle stop at one end adapted to be engaged by and stop the throttle valve control member in various throttle valve idle positions as determined by the axial position of said shaft, said shaft and said housing means having cooperating shaft mounting means by which said shaft is free to move axially but cannot rotate, a reversible motor mounted on said housing means, speed reducing gear means mounted in said housing means including an annular gear that is driven at reduced speed by said motor and is free to move axially to a limited extent, said housing means including gear travel stop means for limiting axial movement of said annular gear, said shaft extending through and having extension and retraction stop means facing opposite sides of said annular gear having an internal thread, said shaft having a screw thread between its two said stop means engageable with the thread in said annular gear whereby said shaft is caused to retract to effect throttle valve closing movement on rotation of said annular gear in one direction by said motor and said shaft is caused to extend to effect throttle valve opening movement on rotation of said annular gear in the opposite direction by said motor, said shaft also having an unthreaded free-wheel portion between its two said stop means passable with clearance past the thread of said annular gear as said shaft extends to and is restrained in a maximum extension position by said extension stop means engaging the other side of said annular gear whereupon said annular gear is then free to rotate about said shaft in said opposite direction, a pivot plate pivotally supported in said housing means, spring means for pivoting said pivot plate to engage and hold said annular gear against one of said gear travel stop means when the throttle control member is removed from said throttle stop and yielding to permit said annular gear to move to engage and be held against the other of said gear travel stop means when the spring biased throttle control member engages said throttle stop, and switch means mounted in said housing means for controlling whether said motor can operate, said switch means including a switch blade connected to said pivot plate so as to close said switch means to permit motor operation when the pivot plate is forced to pivot and hold said annular gear against said other gear travel stop means by the spring biased throttle control member engaging said throttle stop and to open said switch means to prevent motor operation when the pivot plate is forced to pivot and hold said annular gear against said one gear travel stop means when the throttle control member is removed from said throttle stop.

3. An idle speed control device for an internal combustion engine having a throttle valve control member that is spring biased in a valve closing direction, said device comprising housing means adapted to be mounted on the engine, a shaft supported by said housing means having a throttle stop at one end adapted to be engaged by and stop the throttle valve control member in various throttle valve idle positions as determined by the axial position of said shaft, said shaft and said housing means having cooperating shaft mounting means by which said shaft is free to move axially but cannot rotate, a reversible motor mounted on said housing means, speed reducing gear means mounted in said housing means including an annular gear that is driven at reduced speed by said motor and is free to move axially to a limited extent, said housing means including gear travel stop means for limiting axial movement of said annular gear, said shaft extending through and having extension and retraction stop means facing opposite sides of said annular gear, said annular gear having an internal thread, said shaft having a screw thread between its two said stop means engageable with the thread in said annular gear whereby said shaft is caused to retract to effect throttle valve closing movement on rotation of said annular gear in one direction by said motor and said shaft is caused to extend to effect throttle valve opening movement on rotation of said annular gear in the opposite direction by said motor, a helical spring having a twist opposite that of said threads arranged about said shaft between said retraction stop means and one side of said annular gear so as to yieldingly restrain said shaft in a maximum retraction position on annular gear rotation in said one direction and urge extension thereof on annular gear rotation in said opposite direction, said shaft also having an unthreaded free-wheel portion between its two said stop means passable with clearance past the thread of said annular gear as said shaft extends to and is restrained in a maximum extension position by said extension stop means engaging the other side of said annular gear whereupon said annular gear is then free to rotate about said shaft in said opposite direction, a pivot plate pivotally supported in said housing means, spring means for pivoting said pivot plate to engage and hold said annular gear against one of said gear travel stop means when the throttle control member is removed from said throttle stop and yielding to permit said annular gear to move to engage and be held against the other of said gear travel stop means when the spring biased throttle control member engages said throttle stop, and switch means mounted in said housing means for controlling whether said motor can operate, said switch means including a switch blade connected to said pivot plate so as to close said switch means to permit motor operation and thereby idle speed control only when the pivot plate is forced to pivot and hold said annular gear against said other gear travel stop means by the spring biased throttle control member engaging said throttle stop.

* * * * *